US006846252B2

(12) United States Patent
Nudo

(10) Patent No.: US 6,846,252 B2
(45) Date of Patent: Jan. 25, 2005

(54) PRACTICE HOCKEY BOARD

(76) Inventor: Patrick R. Nudo, 1520 W. Lake Shore Dr., Springfield, IL (US) 62707

( * ) Notice: Subject to any disclaimer, the term of this patent is extended or adjusted under 35 U.S.C. 154(b) by 0 days.

(21) Appl. No.: 10/345,258

(22) Filed: Jan. 16, 2003

(65) Prior Publication Data

US 2004/0142775 A1 Jul. 22, 2004

(51) Int. Cl.[7] ..... A63B 67/04; A63B 69/00
(52) U.S. Cl. ..... 473/446; 473/422; 473/278
(58) Field of Search ..... 473/157, 158, 473/159, 164, 415, 446, 478, 278, 422

(56) References Cited

U.S. PATENT DOCUMENTS

| | | | | | |
|---|---|---|---|---|---|
| 4,018,443 | A | * | 4/1977 | Bird | 473/471 |
| 4,030,729 | A | * | 6/1977 | Nathaniel | 472/90 |
| 4,169,688 | A | | 10/1979 | Toshio | |
| 4,294,450 | A | * | 10/1981 | Gallic | 473/159 |
| D281,384 | S | | 11/1985 | Lacey | |
| 4,607,842 | A | * | 8/1986 | Daoust | 473/446 |
| 5,074,556 | A | * | 12/1991 | Loeppky et al. | 273/108.5 |
| 5,131,659 | A | * | 7/1992 | Lindberg, Jr. | 473/267 |
| 5,383,665 | A | * | 1/1995 | Schultz et al. | 473/159 |
| D363,195 | S | | 10/1995 | Bransby | |
| 5,509,652 | A | * | 4/1996 | Woronets | 473/446 |
| D376,671 | S | | 12/1996 | Schonhorn | |
| D378,692 | S | | 4/1997 | Lincoln | |
| 5,645,494 | A | * | 7/1997 | Dionne et al. | 473/278 |
| 5,803,826 | A | * | 9/1998 | Perrine | 473/278 |
| 5,837,343 | A | | 11/1998 | Park et al. | |
| 5,975,526 | A | * | 11/1999 | Hoffman | 273/108.1 |
| 5,988,636 | A | * | 11/1999 | Kilmer | 273/108.1 |
| 6,077,169 | A | * | 6/2000 | Florian | 473/278 |
| 6,139,438 | A | | 10/2000 | Park et al. | |
| 6,364,790 | B1 | | 4/2002 | Carrie et al. | |
| 6,457,711 | B1 | * | 10/2002 | Baulesh | 273/108.1 |
| 6,623,373 | B2 | * | 9/2003 | Carlton et al. | 473/278 |
| 2002/0032084 | A1 | | 3/2002 | Hammett | |

* cited by examiner

*Primary Examiner*—Gregory Vidovich
*Assistant Examiner*—Nini F. Legesse

(57) ABSTRACT

A portable practice hockey device for practicing hockey on any smooth surface has a carrying handle and puck support cups for supporting a plurality of hockey pucks during practice. The device may be used on a driveway or the street for slapping a puck into a net. The device is made of synthetic ice and has chamfered edges such that a puck exits the surface at high speed and into the net. The practice device further provides a testing surface for hockey sticks prior to play on ice.

17 Claims, 2 Drawing Sheets

PRACTICE HOCKEY BOARD

BACKGROUND OF THE INVENTION

The game of hockey has become increasingly more popular in the United States due to the availability of more ice rink time. Although ice skating remains the more profitable business for ice rink owners, there has been an increasing need on the part of the ice rink owner to provide ice time for hockey leagues. Unfortunately, ice rinks are about the only available site for hockey players to practice hockey.

Home built ice rinks are also becoming popular. One form of a home built ice rink is top prepare am outdoor filed border and fill the inside with a plastic ground cover. Water is then injected into the enclosure to provide a skating surface. Outdoor temperatures of less than 32° degrees are required to freeze the water prior to skating.

Another form of home built skating rink is the use of synthetic ice. The use of synthetic ice for skating has been used for over 20 years to build indoor rinks. Examples of synthetic ice are disclosed in U.S. Pat. Nos. 4,169,688, 5,837,343, and 6,139,438.

For the player who does not have the space required for a home built rink there are a few options. Street hockey, played with a round ball is unlike ice hockey. For a beginner, there is a need for the player or a child to be able to walk out the backdoor with a device that allows the user to practice without a rink. There also exists a need for a more experienced hockey player to test the feel of a new stick on the puck in the locker room or anywhere prior to entering the rink.

SUMMARY OF THE INVENTION

A practice hockey device is provided to a player to practice hockey in different environments.

It is an object of the present invention to provide a practice hockey device made of synthetic ice.

It is another object of the present invention to provide a practice hockey device having a handle for carrying the device.

It is another object of the present invention to provide a portable practice hockey device in the form of a synthetic pad having a carrying handle and indented support surfaces for plurality of pucks.

It is another object of the present invention to provide a portable practice hockey device having visual indicators for spotting the puck.

A portable practice hockey device is provided with portable means for transporting the device for use on a flat surface. Puck support cups are formed in the surface of the device for supporting more than one puck in a secure position during practice. The device provided with a chamfered edge so a puck will fly off the surface without catching on the edge of the device. An indicator is provided for creating an imitation faceoff area.

DETAILED DESCRIPTION OF THE DRAWINGS

DETAILED DESCRIPTION OF THE PREFERRED EMBODIMENT

Figure 1:
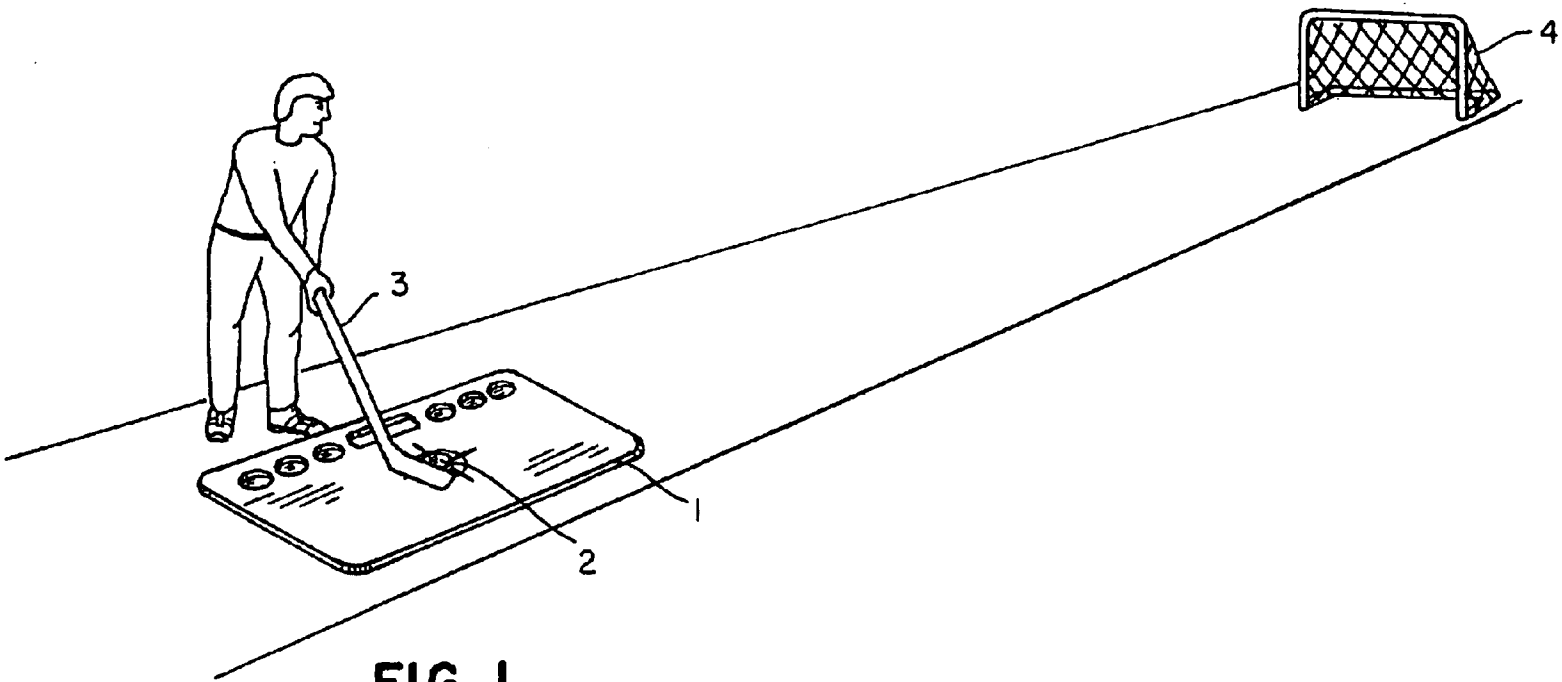
FIG. 1 is a perspective view of a practice hockey board of the present invention positioned on a driveway and ready for use.
Figure 7:
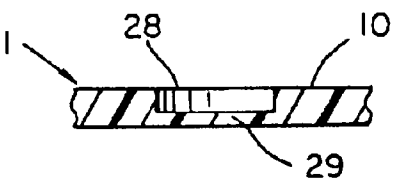
FIG. 7 is a cross sectional view of a cup puck support taken along lines 1—1 of FIG. 2.

The present invention relates to practice devices for the game of hockey. As shown in FIG. 1, a practice hockey device (1) of the present invention is illustrated in position on a generally smooth surface such as a driveway or a street. The practice hockey device 1 is placed on the surface and a standard hockey puck or a field hockey puck (2) designed for use on synthetic ice, is placed on the device (1). A player may use a standard hockey stick (3) and strike the puck into a netted frame (4) also located on the driveway.

Figure 2:
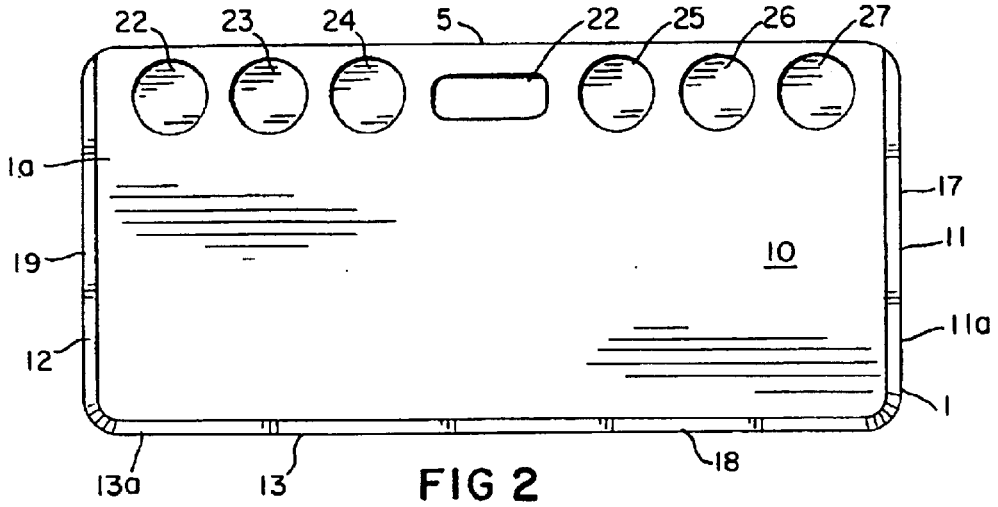
FIG. 2 is a perspective view the present invention practice hockey board.

As illustrated in FIG. 2, the practice hockey device (1) has a body **(1*a*) rear edge (5), a top surface (10), a right edge (11), a left edge (12) and a front edge (13). The device (1) is made of synthetic plastic such as polyethylene. The top surface (10) may be shaved hitting area to provide a shiny appearance or may remain unshaved which provides a more friction on the surface (10)**.

Figure 3:
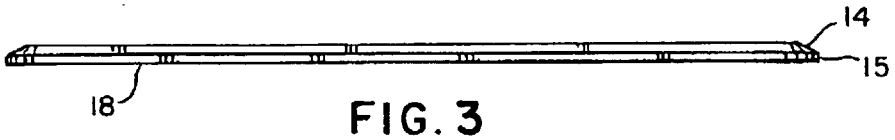
FIG. 3 is a front edge view of the practice hockey board of the present invention.
Figure 5:
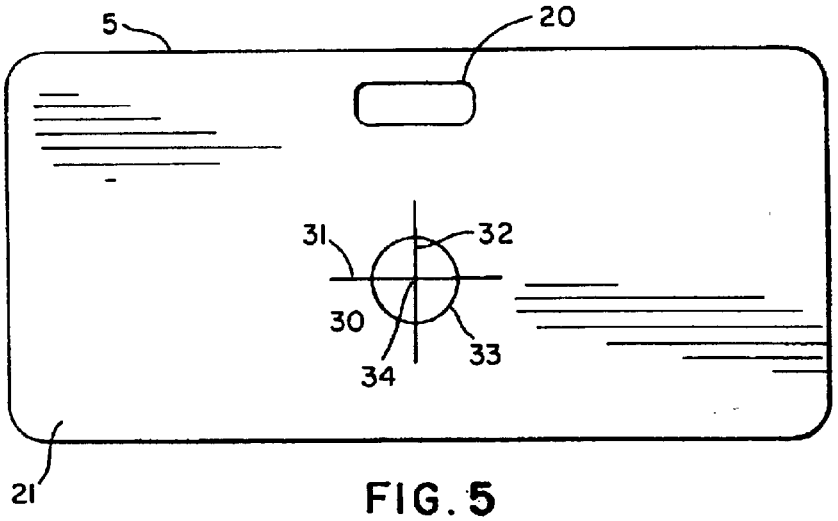
FIG. 5 is a bottom side elevation view of the present invention.

As illustrated in FIGS. 2, 3 and 5, each edge is provided with a chamfered section 14 and a wall section 15. The right edge (11) has a right chamfered section **(11*a*), the front edge 13 has a front chamfered section (13*a*) and the left edge (12) has a left the puck will exit the practice device without any encumbrances. Right edge wall (17), front edge wall (18) and left edge wall (19)** add further stability to the edges of the practice device.

Figure 4:
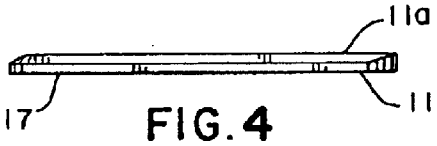
FIG. 4 is a right edge view of the practice hockey board of the present invention.

Returning to FIG. 1, the practice device (1) is provided with a handle (20) positioned in the center of the device adjacent rear edge (5). The handle (20) is formed by an opening in the practice device (1) and can be ergonomically shaped to fit the hand of the player. Since the practice device (1) weighs about 15 lbs and is generally 4–8 feet in length the handle provides a means for carrying the device from storage. Alternatively, the practice device may be constructed without a handle (20). Bottom surface (21) is illustrated in FIG. 4.

Figure 6:
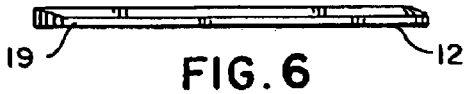
FIG. 6 is a left edge view of the present invention.

As further illustrated in FIG. 2, along the rear edge (5) and on the top surface (10) are one or more circular puck support cups 22–27. Each puck support cup is integrally formed in the practice device. Each cup is formed into the practice device about ½ inches or less in depth and has a radius of about 10 inches or less which is slightly larger than the circumference of a hockey puck used in regulation hockey such as the NHL®. An example of one of the puck support cups is shown in FIG. 6. Each puck support cup has an inner wall (28) and a bottom surface (29). The puck support cups provide a positioning means for supporting a puck on the top surface (10) of the practice device 1 prior to practicing. The puck support cups further prevent the pucks from sliding off the surface (10) of the practice device during practice while the user is taking a shot.

Turning again to FIG. 4, an indicator means (30) is illustrated in the center of the practice device. In this embodiment the practice device is made of translucent or transparent plastic. The indicator means (30) is formed on bottom surface (21) of the practice device 1. The indicator means (30) is formed from a pair of crossing lines (31), (32)

and a circle line (33) which is centered over where the crossing lines (31), (32) intersect. By way of example, the crossing lines (31), (32) are marked in blue and the circle line is marked in red. The indicator means (30) provides a user with a sweet spot for positioning a puck prior to a slap shot. The indicator means (30) also provides a means for imitating a faceoff practice area (34).

The practice hockey device may be used on a driveway or the street for slapping a puck into a net. The device is made of synthetic ice and has chamfered edges such that a puck exits the surface at high speed and into the net. Surprisingly, the device also provides a testing surface for hockey sticks prior to play on ice. A puck may be moved over the surface in a back and forth method to get a feel for the stick.

In order to use the portable hockey practice device, the user may pick up the device and carry the device to the play area using the handle. A conventional synthetic hockey puck (2) may be placed on the surface for practice. Additional pucks may be placed in the support indentations for convenience in taking the next shot. The player may uses s stick to move a puck around on the practice device in order to get a feel for the stick to see if that particular stick has a feel that fits the player. A player may also take a slap shot with the puck into a net. The puck will quickly travel off the practice device. Due to the construction of the practice device there is no harm to the stick.

What is claimed is:

1. A practice hockey device for practicing a hockey shot with a hockey stick and a hockey puck, said practice device comprising, a body, said body made entirely of polythene having a shaved hitting area for hitting hockey pucks, said body having an integrally formed bottom surface, top surface, right edge, left edge, front edge and rear edge, each edge is provided with a chamfered section, and a wall section so said puck will exit the practice device without any encumbrances, said top surface provided with at least one or more puck support cups, each cup having an inner wall and a bottom wall for supporting hockey pucks prior to practice, each cup having a depth of less the ½ inch and a radius of less than 10 inches.

2. A practice hockey device for practicing a hockey shot as recited in claim 1, said practice device further comprising a handle.

3. A practice hockey device for practicing a hockey shot as recited in claim 1, said practice device further comprising indicator means for imitating a face off area.

4. A practice hockey device for practicing a hockey shot as recited in claim 1, said practice device made of transparent polyethylene plastic.

5. A practice hockey device for practicing a hockey shot as recited in claim 1, said practice device comprising translucent polyethylene plastic.

6. A practice hockey device for practicing a hockey shot as recited in claim 1, said top surface having a shaved hitting area (are).

7. A practice hockey device for practicing a hockey shot with a hockey stick and a hockey puck, said practice device comprising, a body having an integrally formed bottom surface, said body made entirely of polythene having a shaved hitting area for hitting hockey pucks, said body having a top surface, right edge, left edge, front edge and rear edge, each edge is provided with a chamfered section, and a wall section so said puck will exit the practice device without any encumbrances, said top surface provided with at least one or more puck will exit the practice device without any encumbrances, said top surface provided with at least one or more puck support cups for supporting hockey pucks, each cup having an inner wall and a bottom wall each cup having a death of less the ½ inch, and a radius of less than 10 inches, and indicator means for imitating a face off area, said indicator means made of colored lines formed on said bottom surface of said practice device.

8. A practice hockey device for practicing a hockey shot as recited in claim 7, said practice device further comprising a handle.

9. A practice hockey device for practicing a hockey shot as recited in claim 7, said practice device further comprising crossing lines having an intersection surrounded by a circle line.

10. A practice hockey device for practicing a hockey shot as recited in claim 7, said practice device made of transparent high density polyethylene plastic.

11. A practice hockey device for practicing a hockey shot as recited in claim 7, said practice device comprising translucent high density polyethylene plastic.

12. A practice hockey device for practicing a hockey shot as recited in claim 7, said top surface having chamfered edges (a shaved hitting area).

13. A practice hockey device for practicing a hockey shot with a hockey stick and a hockey puck, said practice device comprising, a body, said body made entirely of polythene having a shaved hitting area for hitting hockey pucks, said body having an integrally formed bottom surface, top surface, right edge, left edge, front edge and rear edge, said top surface provided with at least one or more puck support cups, each cup having an inner wall and a bottom wall for supporting hockey pucks prior to practice, each cup having a depth of less the ½ inch and a radius of less than 10 inches.

14. A practice hockey device for practicing a hockey shot as recited in claim 13, said practice device further comprising a handle.

15. A practice hockey device for practicing a hockey shot as recited in claim 13, said practice device further comprising indicator means for imitating a face off area.

16. A practice hockey device for practicing a hockey shot as recited in claim 13, said practice device made of transparent polyethylene plastic.

17. A practice hockey device for practicing a hockey shot as recited in claim 13, said practice device comprising translucent polyethylene plastic.

* * * * *